US011166580B2

(12) United States Patent
Waisanen et al.

(10) Patent No.: US 11,166,580 B2
(45) **Date of Patent: *Nov. 9, 2021**

(54) TAMPER RESISTANT SELF-LOCKING PACKAGE DELIVERY SYSTEM

(71) Applicants: Carl R. Waisanen, Colorado Springs, CO (US); Pamela J. Waisanen, Colorado Springs, CO (US)

(72) Inventors: Carl R. Waisanen, Colorado Springs, CO (US); Pamela J. Waisanen, Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/918,697

(22) Filed: Jul. 1, 2020

(65) Prior Publication Data

US 2020/0323376 A1 Oct. 15, 2020
US 2021/0315404 A9 Oct. 14, 2021

Related U.S. Application Data

(63) Continuation of application No. 16/384,322, filed on Apr. 15, 2019, now Pat. No. 10,772,450.
(Continued)

(51) Int. Cl.
*A47G 29/14* (2006.01)
*E05B 65/06* (2006.01)
(Continued)

(52) U.S. Cl.
CPC ..... *A47G 29/141* (2013.01); *A47C 7/628* (2018.08); *A47G 29/20* (2013.01);
(Continued)

(58) Field of Classification Search
CPC ..... A47G 29/141; A47G 29/20; A47G 29/14; A47G 29/16; A47G 29/124; A47G 2029/145; A47G 2029/148; A47G 2029/149; E05F 15/60; E05F 15/616; A47C 7/628; A47C 13/00; A47C 11/00; E05B 47/0002; E05B 65/06; E05C 17/085; G07C 9/00309; G07C 9/00912; G07C 2009/00769; G08B 13/19602; G08B 13/1966; G08B 13/19684; G08B 13/196;
(Continued)

(56) References Cited

U.S. PATENT DOCUMENTS 10,039,401 B1 * 8/2018 Romanucci ..... A47C 7/628
10,827,686 B2 * 11/2020 Benevelli ..... A01F 15/0825
(Continued)

*Primary Examiner* — William L Miller
(74) *Attorney, Agent, or Firm* — Dale J. Ream

(57) ABSTRACT

A self-locking parcel delivery apparatus and method includes a tamper-resistant compartment beneath a lid of a porch bench seat and insulated for protecting delivered parcels. The apparatus includes a lid that is held open magnetically until proactively released to close and lock (such as by a delivery person) or by a remote user via a primary software application running on a mobile communications device. The apparatus may be operated in conjunction or cooperation with a supplemental software application associated with a video motion detection system so that a remote user can authenticate a supposed delivery person and then, using another software app, activate a remote delivery container to be made ready to receive a delivered parcel.

10 Claims, 18 Drawing Sheets

Related U.S. Application Data

(60) Provisional application No. 62/771,140, filed on Nov. 25, 2018.

(51) Int. Cl.

| | |
|---|---|
| ***E05F 15/60*** | (2015.01) |
| ***E05B 47/00*** | (2006.01) |
| ***A47G 29/20*** | (2006.01) |
| ***A47C 7/62*** | (2006.01) |
| ***G08B 13/196*** | (2006.01) |
| ***G07C 9/00*** | (2020.01) |
| ***E05C 17/08*** | (2006.01) |

(52) U.S. Cl.

CPC ..... *E05B 47/0002* (2013.01); *E05B 65/06* (2013.01); *E05C 17/085* (2013.01); *E05F 15/60* (2015.01); *G07C 9/00309* (2013.01); *G07C 9/00912* (2013.01); *G08B 13/1966* (2013.01); *G08B 13/19602* (2013.01); *G08B 13/19684* (2013.01); *A47G 2029/145* (2013.01); *E05Y 2900/602* (2013.01); *G07C 2009/00769* (2013.01)

(58) Field of Classification Search

CPC ..... E05Y 2900/602; E05Y 2201/22; E05Y 2201/686; E05Y 2201/426; B65D 55/14; E05G 7/001

USPC ..... 232/19, 38, 44, 45; 70/63, 159, 160, 70/162, 101, 106; 297/118; 109/64; 292/144; 340/5.73, 569

See application file for complete search history.

(56) References Cited

U.S. PATENT DOCUMENTS

| | | | | |
|---|---|---|---|---|
| 2001/0045449 | A1* | 11/2001 | Shannon | G07C 9/21 232/19 |
| 2016/0247344 | A1* | 8/2016 | Eichenblatt | H04N 7/183 |
| 2017/0011605 | A1* | 1/2017 | Grabham | A47G 29/30 |
| 2017/0055751 | A1* | 3/2017 | Sundaresan | A47G 29/20 |
| 2017/0101237 | A1* | 4/2017 | Capous | A47G 29/20 |
| 2018/0070753 | A1* | 3/2018 | Eveloff | A47G 29/141 |
| 2018/0303265 | A1* | 10/2018 | Hearne | A47G 29/22 |
| 2018/0310714 | A1* | 11/2018 | Becker | A47C 11/00 |
| 2019/0000255 | A1* | 1/2019 | Dehner | E05B 47/023 |
| 2019/0130348 | A1* | 5/2019 | Mellado | G07C 9/00912 |
| 2019/0239650 | A1* | 8/2019 | Nelson | E05B 65/52 |
| 2019/0368259 | A1* | 12/2019 | Wei | A47G 29/20 |
| 2019/0387910 | A1* | 12/2019 | Stoich | G07C 9/37 |
| 2020/0077826 | A1* | 3/2020 | Chenier | G07C 9/00912 |
| 2020/0390260 | A1* | 12/2020 | Romanucci | A47G 29/141 |
| 2020/0397172 | A1* | 12/2020 | Kennett | G07C 9/00896 |

* cited by examiner

TAMPER RESISTANT SELF-LOCKING PACKAGE DELIVERY SYSTEM

REFERENCE TO RELATED APPLICATIONS

This application is a continuation-in-part and claims the benefit of non-provisional application Ser. No. 16/384,322 filed April 2019 titled Tamper Resistant Self-Locking Package Delivery System, which claims the benefit of provisional patent application Ser. No. 62/771,140 filed Nov. 25, 2018 titled Tamper Resistant Self-Locking Package Delivery System, which is incorporated completely herein by reference.

BACKGROUND OF THE INVENTION

This invention relates generally to parcel delivery devices having "smart" components for remote access and, more particularly, to a smart parcel delivery system that enables an owner to open a magnet secured parcel receiving apparatus after first authenticating an on-premises or on-porch motion detection via a video motion detection system (e.g. a video doorbell). In other words, a resident may be notified by a video motion system (such as the video doorbell system marketed as the RING™ doorbell) that a potential delivery man is approaching and then, once confirmed by a resident, an associated delivery container having a magnet locking assembly may be remotely actuated so that a parcel may be left and then automatically locked or locked until a next delivery is made in the same manner.

Online shopping continues to grow nationally and internationally. In the U.S, online retail sales estimates range from $250 billion to $459 billion. In recent years there has been an estimated 5.9% to 8.8% increase per year across the board. This same upward trend is expected in the future because of convenience to the consumer and efficiency for the seller. However, the downside of e-commerce for sellers is that packages are frequently stolen: burglars may tail a delivery driver and pounce on the merchandise as soon as the driver is out of sight. In 2015, 11 million Americans have had packages stolen from their homes and, in 2018, it is estimated that 23 million Americans will have packages stolen.

Therefore, it would be desirable to have a package delivery system that may be placed on the premises of a residence or business that securely receives delivered parcels in a manner that is secure, clandestine, and convenient. The package delivery system may have one or more secure and tamper-resistant compartments that may also serve as a bench seat and may also be insulated for protecting delivered parcels, such as those with perishable items, from weather and temperature elements.

SUMMARY OF THE INVENTION

The invention is designed to be used by itself or in conjunction with a property that utilizes a video security system, such as is marketed as RING™ (hereafter referred to simply as RING or the Ring doorbell system). It is also designed to remain locked when not being used, to prevent would-be thieves from disabling the internal mechanics. Each compartment in the storage container, according to one embodiment discussed below, has a magnetic lock that, when activated, holds the spring-loaded lid support legs and feet in a raised position—the delivery-ready position—preventing the lid from locking when the lid is opened and then closed. This feature prevents a "porch pirate" from being able to lock the lid shut prior to delivery (thus forcing the deliverer(s) to leave packages outside of the box where they may be stolen later). The magnetic locks may be activated or deactivated remotely via a software application, i.e. a phone app. The day that a delivery is expected the owner can activate the magnetic lock(s), position the spring-loaded lid support legs and feet in the up position (holding the lid in a raised or open position), and the magnetic lock will hold them in the up position until deactivated. When the owner is notified, via the video security system, that the delivery driver is approaching, the owner can deactivate the magnetic lock remotely with the phone app, allowing the container to be locked automatically when the delivery driver closes the lid. When the magnetic lock is activated, a person other than the delivery person or the owner can open and close the lid over and over again without activating the locking mechanism, i.e. an activated magnet holds the legs up so as to hold the lid open.

This remote activation and deactivation of the magnetic locks will only be useful if the property has a security system that notifies the owner of an approaching delivery person (who may be referred to herein as a "supposed" or "alleged" or "potential" delivery driver. The resident will have opportunity to see and speak to the supposed delivery person and authenticate him using the previously installed video motion detection system.

But, for those properties that do not have a video motion security system such as Ring, the owner will manually set up the container for delivery and hope that no one opens and closes the lid before the delivery driver delivers the package. As soon as the lid is opened without the use of the magnetic locks, the spring-loaded legs and feet will spring to the down position allowing the lid to be locked in the closed position (as will be described in detail later).

The invention may also provide proof of delivery barcoding for senders and recipients. The Proof of Delivery may be transmitted via existing technologies to confirm delivery.

Therefore, a general object of this invention is to provide a package delivery system that is held open magnetically until the lid is proactively released to close and lock, either by first lifting the lid so as to release the holding mechanism or by a remote user via a software application running on a mobile communications device.

Another object of this invention is to provide a package delivery system, as aforesaid, that may operate in conjunction or cooperation with a software app associated with a video motion detection system so that a remote user can authenticate a supposed delivery person and then remotely activate a delivery container to be made ready to receive a delivered parcel.

Still another object of this invention is to provide a package delivery system, as aforesaid, having one or more compartments and one or more lids that may be operated independently from remote locations via the associated software app. In fact, any number of walls, arms, compartments, and dividers may be included in the manufactured product. The center wall between the two compartments is meant to be removable for larger packages that are too big for a single compartment. A delivery driver may open both lids to place the larger package.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
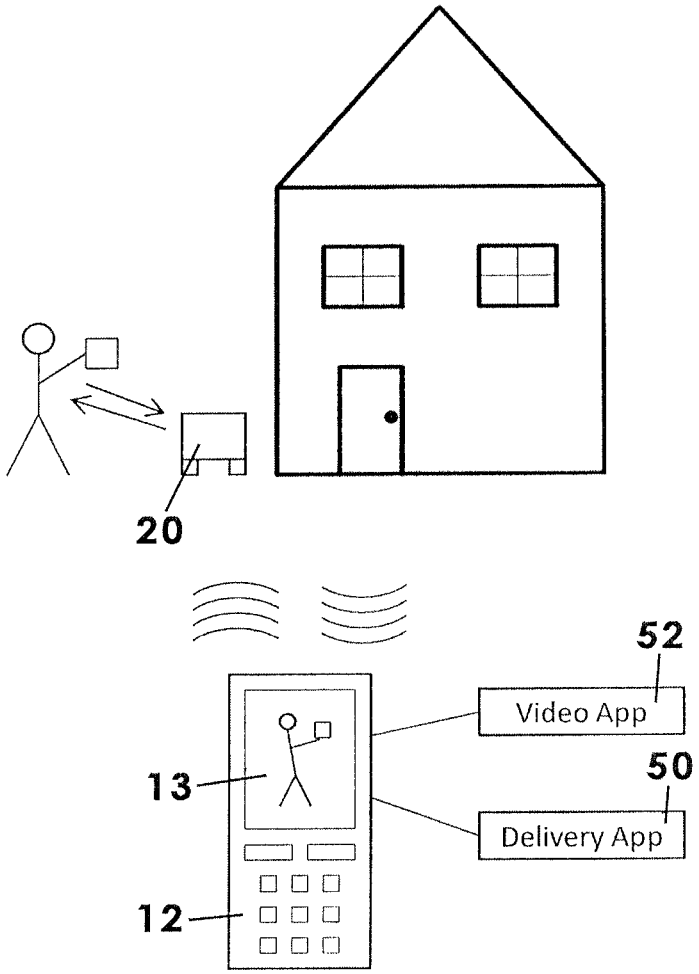
FIG. 1 is a schematic plan view of a self-locking parcel receiving apparatus and method according to the present invention.

A tamper resistant self-locking parcel receiving apparatus and method will now be described in detail with reference to FIGS. 1 to 14 of the accompanying drawings. The tamper resistant self-locking parcel receiving apparatus 10 includes a delivery container 20 having a lid 24 which may be held in a raised configuration by one or more self-locking legs 30 and a magnet locking mechanism. Several electronic and electromechanical components are included in the design explained below and may be powered by an electrical power source 15 such as a battery (DC electrical power) or direct AC current such as from a wall socket via a wire.

In the preferred embodiment, the delivery container 20 is constructed in the form of a functional bench seating device that is frequently found on a residential porch or even at a business location. It is understood that the bench seat may include arms and a back as shown in some illustrations. While fully functional as a bench for seating, the delivery container 20 may include one or more compartments capable of receiving one or more delivered parcels as described below. Specifically, the delivery container 20 may include a plurality of walls 22 connected together in a manner that defines at least one interior area dimensioned to contain or hold at least one normal sized parcel, e.g. a boxed parcel. In one embodiment, the walls 22 may define two interior areas divided by a removable partition 23 or divider wall so that two parcels may be received into separate areas. The center wall between the two compartments is meant to be removable for larger packages that are too large for a single compartment. A delivery driver may open both lids to place the larger package. This is particularly helpful if one interior area is constructed of insulated walls for receiving a parcel needing to be kept cold, such as medicine, food, or the like. The bench delivery container 20 may include one or more anchor brackets 21 for securing the bench to the floor of a porch—such as would be useful to prevent the entire container from being stolen.

Figure 8:
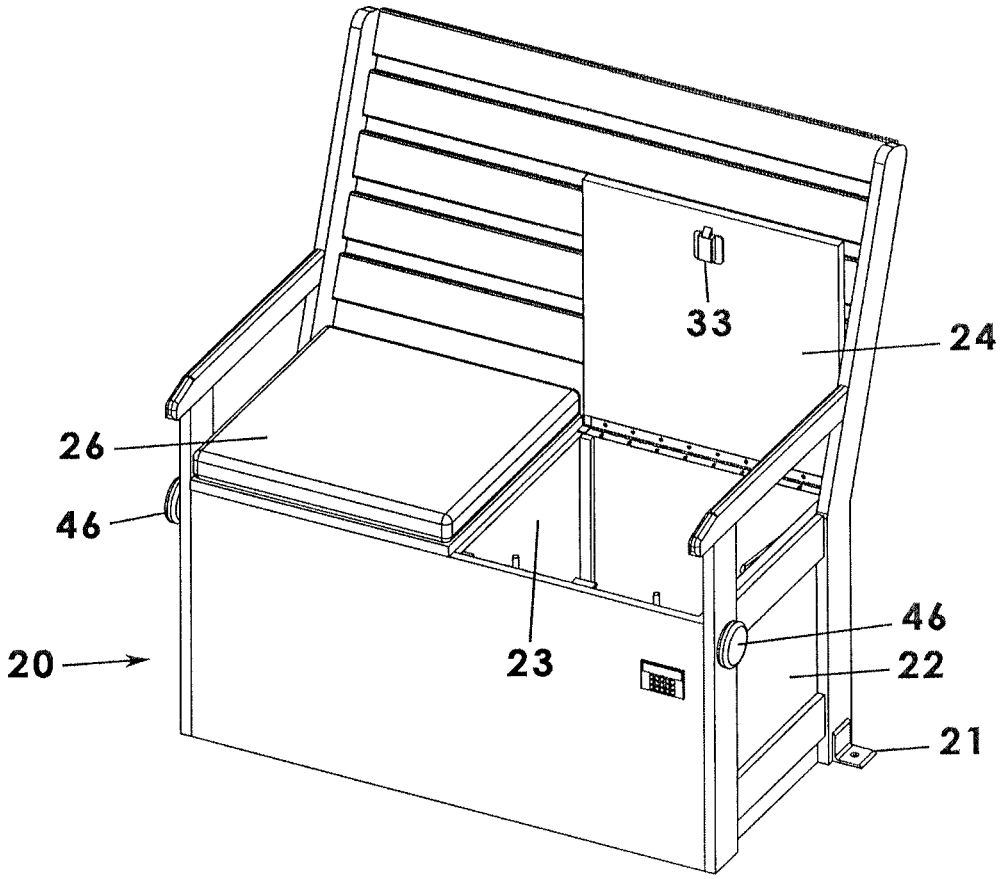
FIG. 8 is a perspective view of the delivery container according to the present invention, illustrated constructed as a porch bench with back and arms.

Further, the walls may enclose a bottom and upstanding sides that are arranged to define an open top. A parcel may be deposited into an interior area via the open top. A lid 24 is pivotally coupled to upper edges of the upstanding walls, such as with hinges. Thus, the lid 24 may be pivotally raised along the hinges, either partially or completely, in order to give access to the interior area, e.g. for parcel delivery or retrieval. Stated another way, the interior area is not accessible when the lid 24 is in a closed configuration whereas the interior area may be accessed when the lid 24 is in an open configuration. The lid 24 will also be raised a predetermined amount when the delivery container 20 is being readied for delivery and automatically locked as will be described more fully later. In an embodiment, the lid 24 may be divided into two lid portions for covering two opening of two interior areas, respectively, as shown in FIG. 8.

Figure 7A:
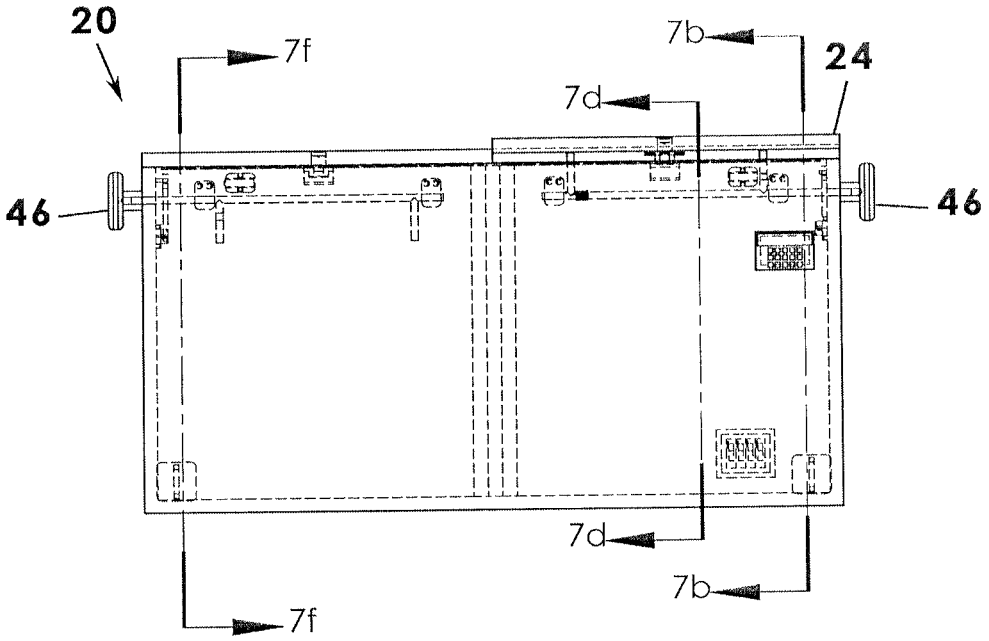
FIG. 7*a* is a front view of the delivery container as in FIG. 3*a;*
Figure 7B:
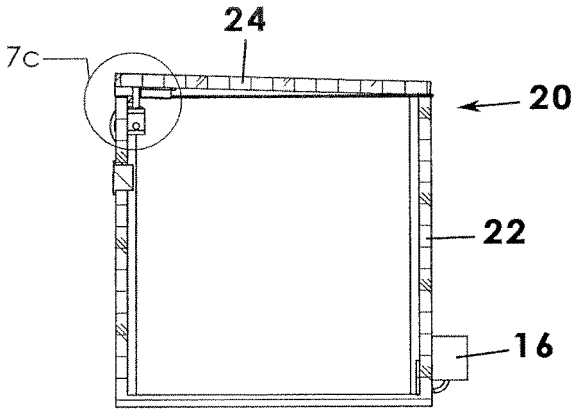
FIG. 7*b* is a sectional view of the delivery container taken along line 7*b*-7*b* of FIG. 7*a;*
Figure 7D:
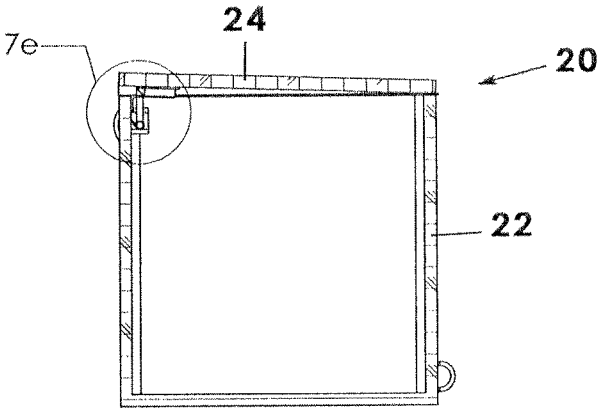
FIG. 7*d* is a sectional view of the delivery container taken along line 7*d*-7*d* of FIG. 7*a;*
Figure 7C:
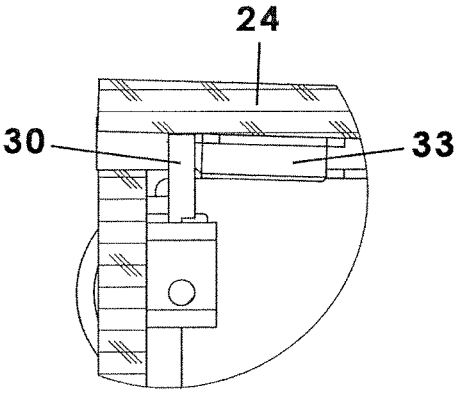
FIG. 7*c* is an isolated view on an enlarged scale taken from FIG. 7*b;*
Figure 7E:
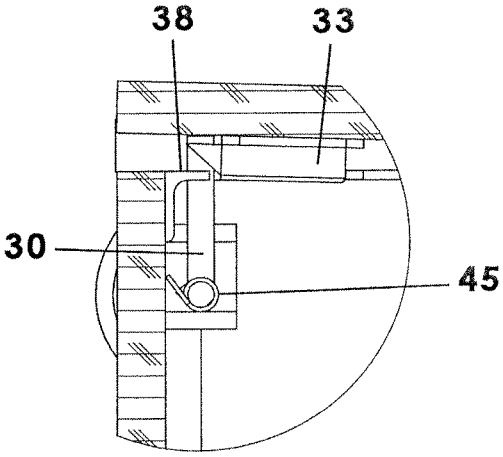
FIG. 7*e* is an isolated view on an enlarged scale taken from FIG. 7*d;*
Figure 7F:
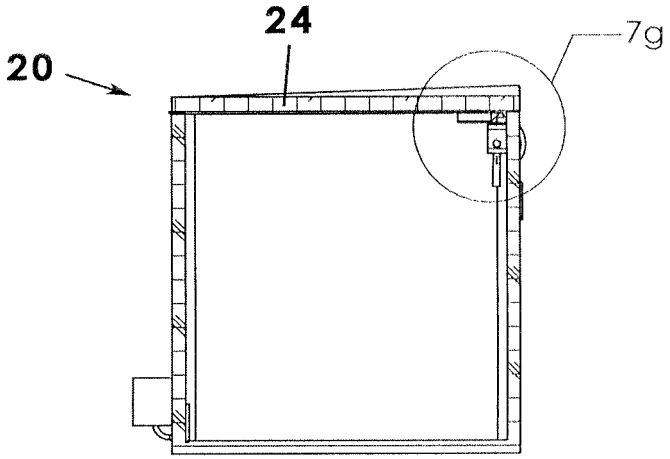
FIG. 7*f* is a sectional view of the delivery container taken along line 7*f*-7*f* of FIG. 7*a;*
Figure 7G:
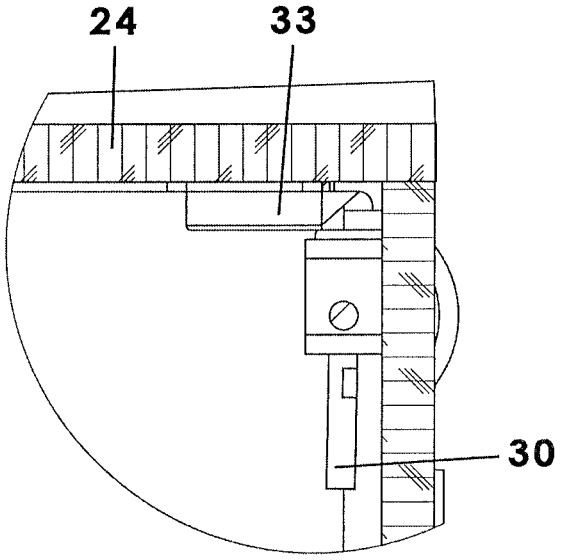
FIG. 7*g* is an isolated view on an enlarged scale taken from FIG. 7*f;*

Next, the invention includes a triggering assembly for essentially "setting the trap" or as may be described as "preparing" the delivery container 20 to receive a parcel in a manner that will enable the lid 24 to be locked in a closed configuration automatically following an opening of the lid 24 and then closing of the lid 24 by a delivery person. More particularly, the triggering assembly may include at least one support leg 30 although, preferably, includes a pair of support legs spaced apart laterally. A support leg 30 is positioned inside the interior area and may be pivotally mounted to a respective wall 22, such as is shown attached to an inner surface of a front wall in FIG. 4*b* of the drawings. The support leg 30 may be pivotally movable between a retracted or down configuration inside the interior area and an upstanding or upwardly deployed configuration in which a terminal end thereof extends above an upper edge of the upstanding walls and upon which the lid 24 will rest if moved downwardly or is closing (FIG. 7*b*). In other words, a support leg 30, when actuated, holds the lid 24 in a partially raised configuration—which is important in placing the delivery container in a delivery-ready configuration. Specifically, the delivery container 20 is in a delivery-ready configuration when the lid 24 is partially raised and the support leg 30 is in the upward configuration (i.e. the open configuration). Each support leg 30 may have a spring-loaded construction and is normally biased in a downward direction within the interior area such that the support leg 30 must be held in the upwardly extended configuration by a mechanical or magnetic means as will be described later.

Figure 4A:
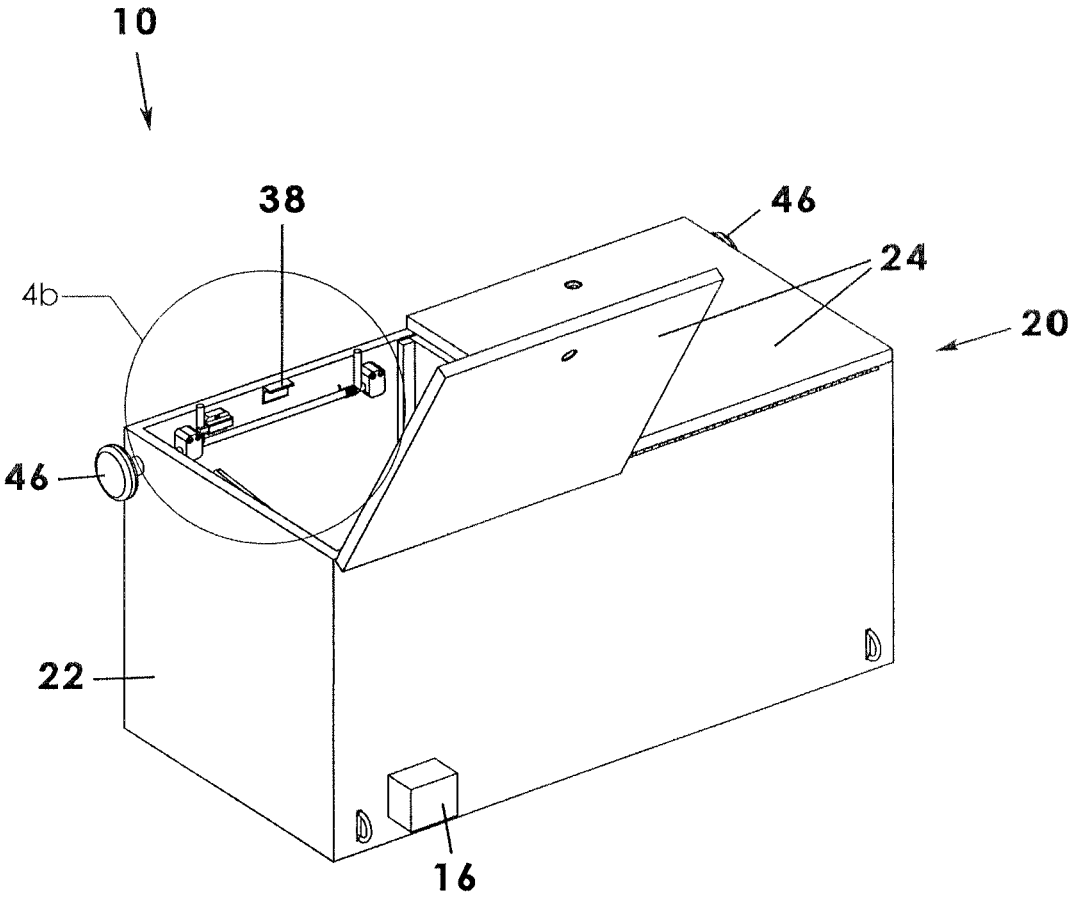
FIG. 4*a* is another perspective view of the delivery container as in FIG. 3*b*, illustrated with one lid portion in an open configuration and the support legs in a deployed configuration.
Figure 4B:
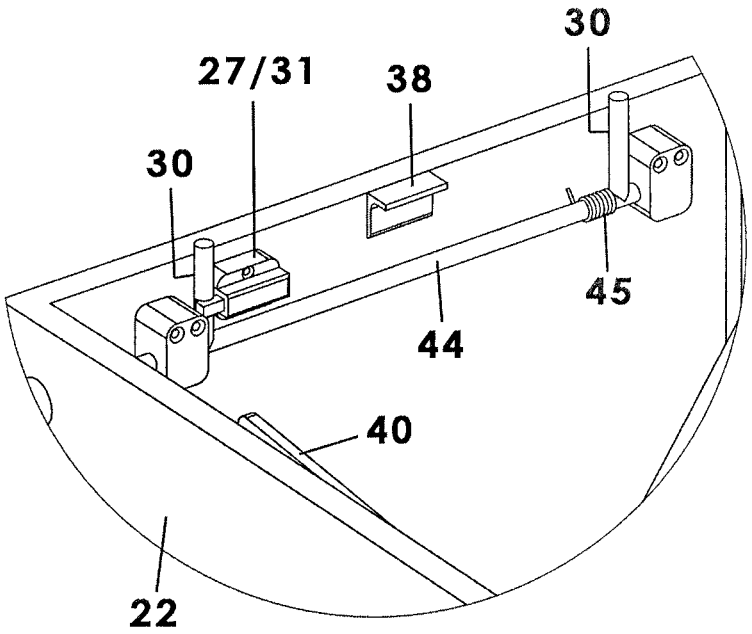
FIG. 4*b* is an isolated view on an enlarged basis taken from FIG. 4*a;*

More particularly, the triggering assembly may be "set" by operation of a mechanical linkage. Specifically, the setting linkage may include a rod 44 having a linear configuration and having a length that extends both inside and outwardly from the delivery container 20. A knob 46 or similar fastener is coupled to an end of the rod 44 and is displaced exteriorly from a side wall of the delivery container 20. Opposite the knob 46, the support leg(s) 30 may be coupled to the rod 44 in a manner that allows the supports legs to be pivoted to the upstanding configuration upon rotation of the knob 46, i.e. in a cam-action. The linkage may be operably coupled to the lid lifting arm 40 so that the lid 24 is raised a predetermined amount by rotation of the knob 46. The linkage enables a user to set the triggering assembly manually, such as when a delivery is anticipated and in embodiments where the triggering assembly cannot be set remotely as described below (i.e. in purely mechanical embodiments). The support legs 30 may be held in the up position by manually activated solenoid leg locks 27 (FIG. 4*b*). In other words, the solenoid leg locks 27 may be activated by a user when the triggering assembly is set. Then, the solenoid leg locks 27 may be released remotely by the owner, such as by using a mobile app as will be described later.

Figure 11A:
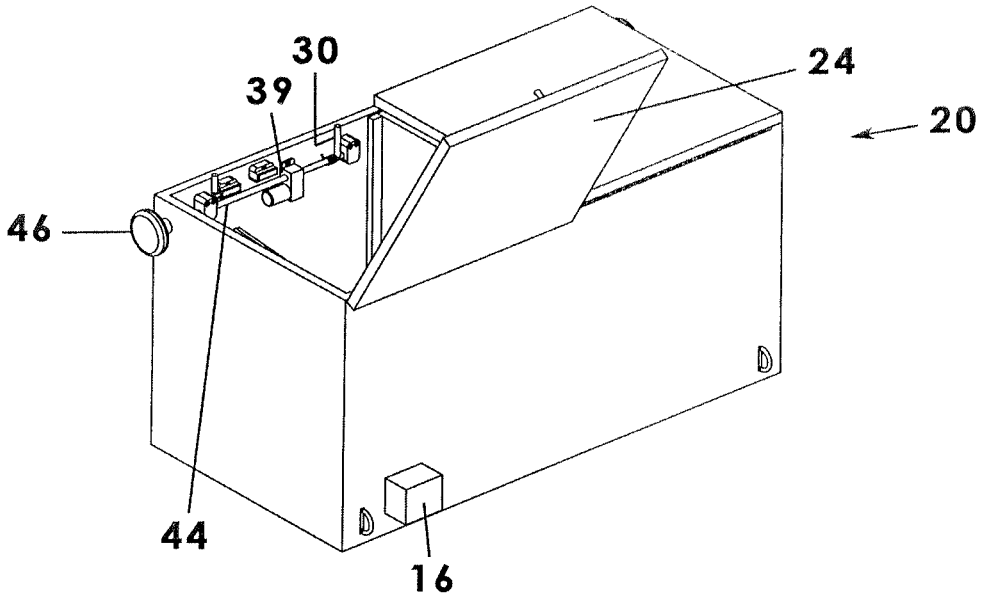
FIG. 11*a* is a perspective view of the delivery container of FIG. 1, illustrated with an electric actuator coupled to a rod operable for actuating the support legs to the deployed configuration.
Figure 11B:
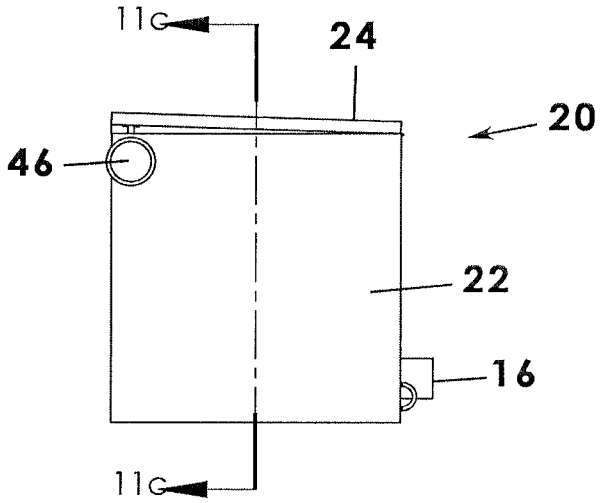
FIG. 11*b* is as side view of the delivery container as in FIG. 11*a;*
Figure 11C:
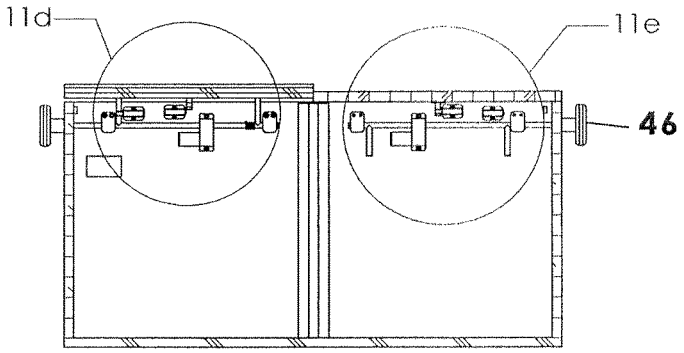
FIG. 11*c* is a sectional view taken along line 11*c*-11*c* of FIG. 11*b;*
Figure 11D:
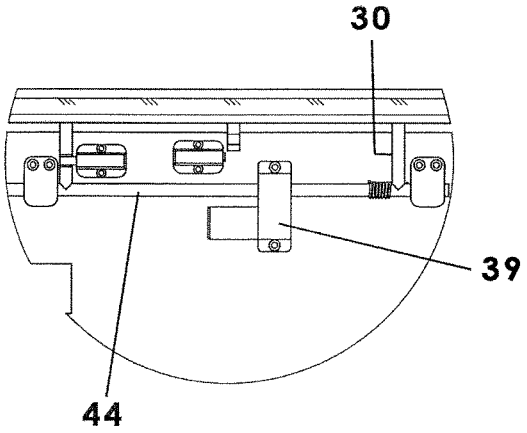
FIG. 11*d* is an isolated view on an enlarged scale taken from FIG. 11*c;*
Figure 11E:
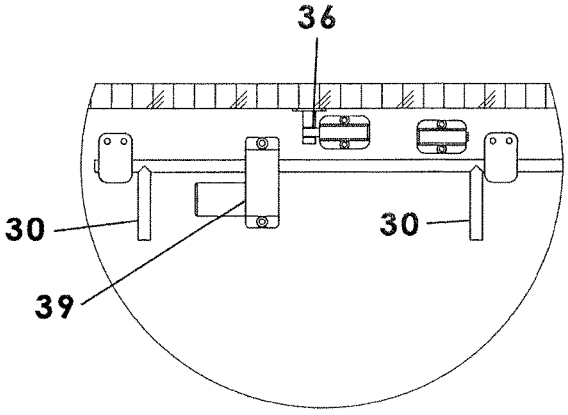
FIG. 11*e* is an isolated view on an enlarged scale taken from FIG. 11*c;*
Figure 12A:
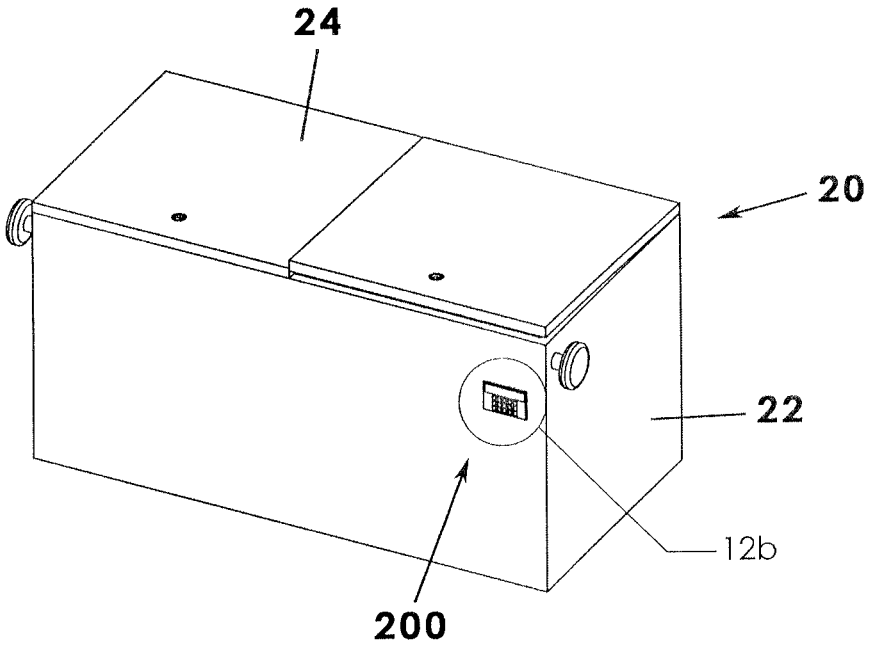
FIG. 12*a* is a front perspective view of a delivery container according to an embodiment of the present invention.
Figure 12B:
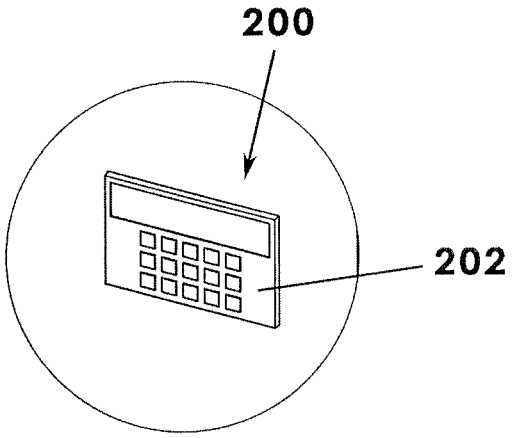
FIG. 12*b* is an isolated view on an enlarged scale taken from FIG. 12*a;*

Further, in a remote-access embodiment described later, a second leg lifting actuator 39 may be connected to the rod 44 and operable to rotate the rod 44 in the cam-like manner so as to raise the support leg(s) 30 to the upward and lid-holding configuration, i.e. the triggering assembly may be first "set up" remotely (via the second leg lift actuator 39 that rotates the rod 44 as shown in FIGS. 11*d* and 11*e*) as well as then being deactivated remotely (i.e. via the first leg lift actuator 31, the solenoid holding the support legs 30 in the upward configuration is retracted allowing the support legs 30 to return to their normally down position when the delivery person delivers the package).

Figure 5A:
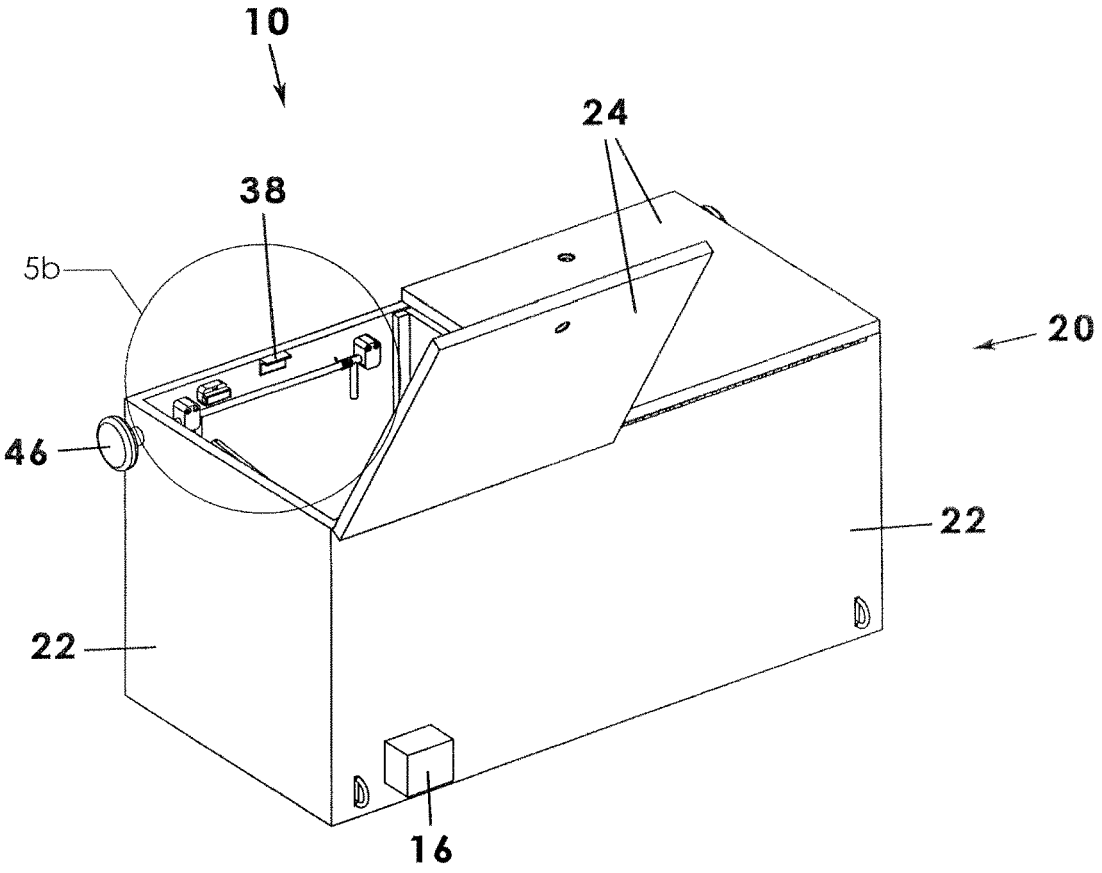
FIG. 5*a* is another perspective view of the delivery container as in FIG. 3*b*, illustrated with one lid portion in an open configuration and the support legs in a released configuration.
Figure 5B:
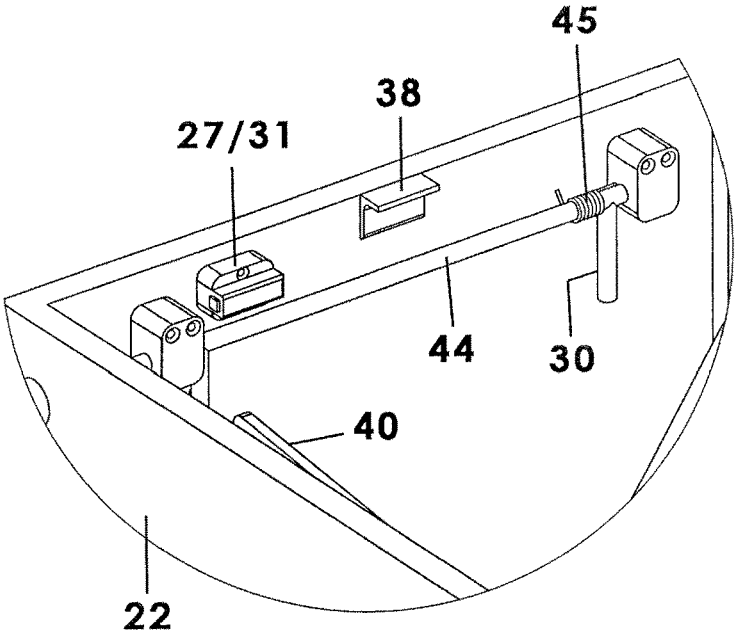
FIG. 5*b* is an isolated view on an enlarged basis taken from FIG. 5*a;*
Figure 6A:
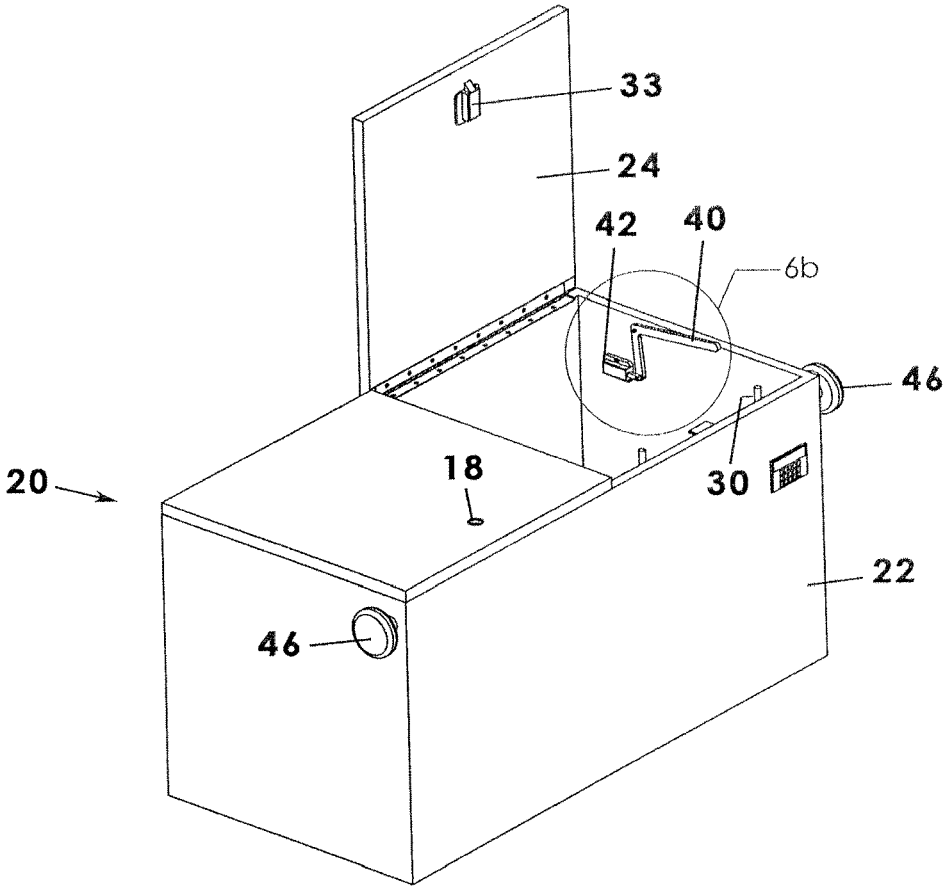
FIG. 6*a* is another perspective view of the delivery container as in FIG. 3*b*, illustrated with one lid portion in an open configuration and a lid lifting arm in a deployed configuration.
Figure 6B:
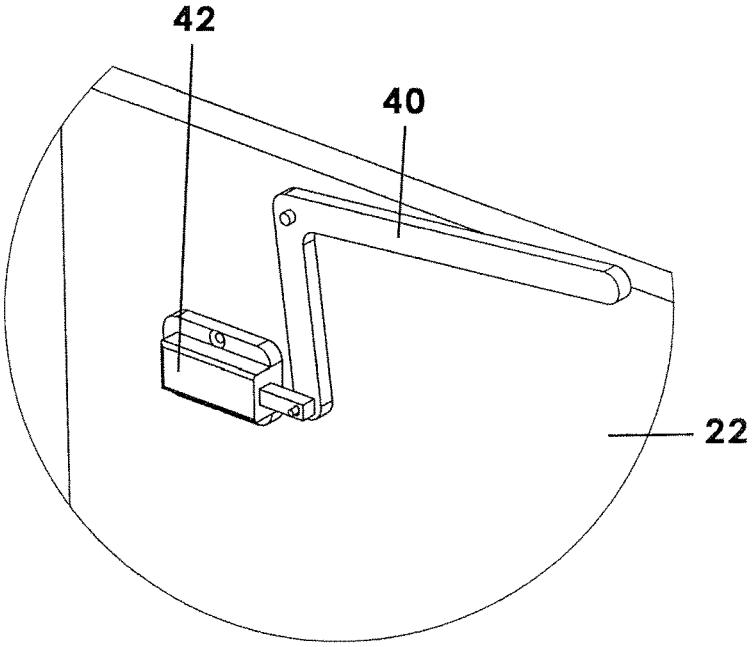
FIG. 6*b* is an isolated view on an enlarged scale taken from FIG. 6*a;*

Now, with even further description of a purely mechanical arrangement (and not having any electromagnetic structures), the support leg 30 may be held in the upstanding configuration by solenoid leg locks 27 so that the lid 24 is resting on the support legs 30. It will be understood that the reference to leg locks 27 is merely a more specific type of leg actuator 31 referred to elsewhere for holding the support legs 30 in place. Therefore both leg locks 27 and a first leg actuator 31 is accurate and interchangeable as used herein and is indicated intentionally in this manner, such as on FIG. 4*b*. Then, when the solenoid leg locks 27 are deactivated by the owner and the lid 24 is raised further, such as by the delivery person inserting a parcel, the support leg 30 is no longer held and is allowed to springably and pivotally return automatically to the downward or retracted configuration. Specifically, each support leg 30 is operably connected to a spring 45 and biased toward the closed or down position, the spring 45 being coupled, at one end, to a respective wall or to the rod 44 itself and, and another end, to the support leg 30. Then, when the lid 24 is closed by the delivery person, the lid 24 is allowed to close completely into contact with upper edges of respective walls of the delivery container 20 (FIG. 5*b*).

Figure 3A:
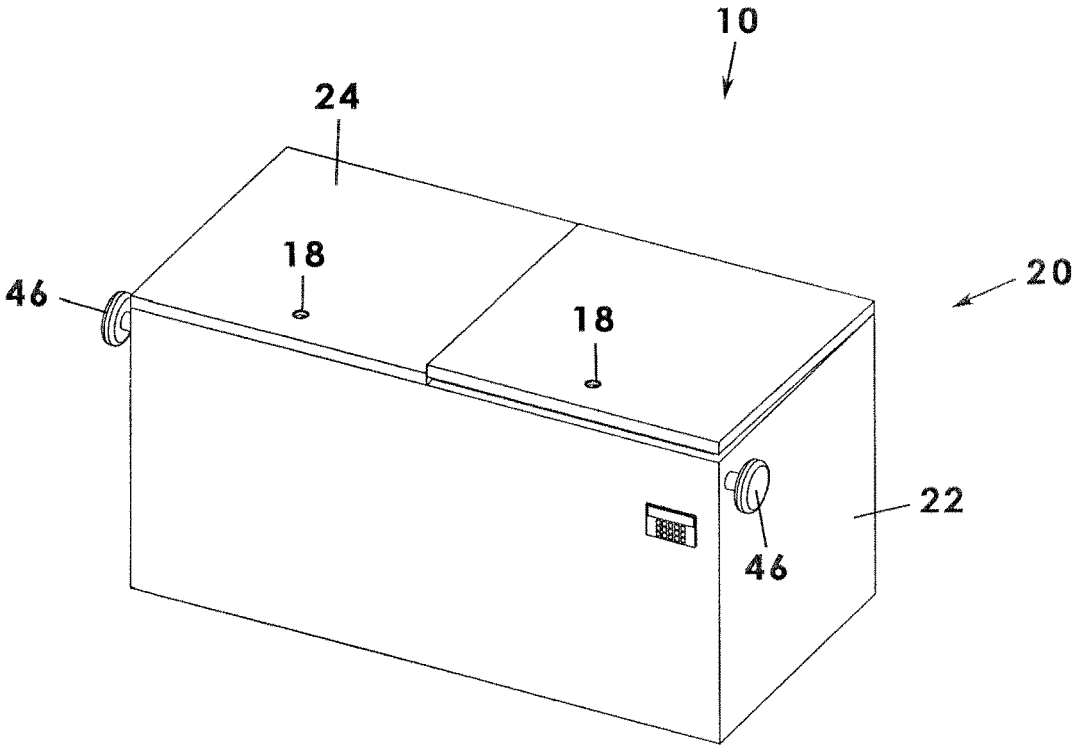
FIG. 3*a* is a front perspective view of a delivery container for the two container option according to the apparatus of FIG. 1.
Figure 3B:
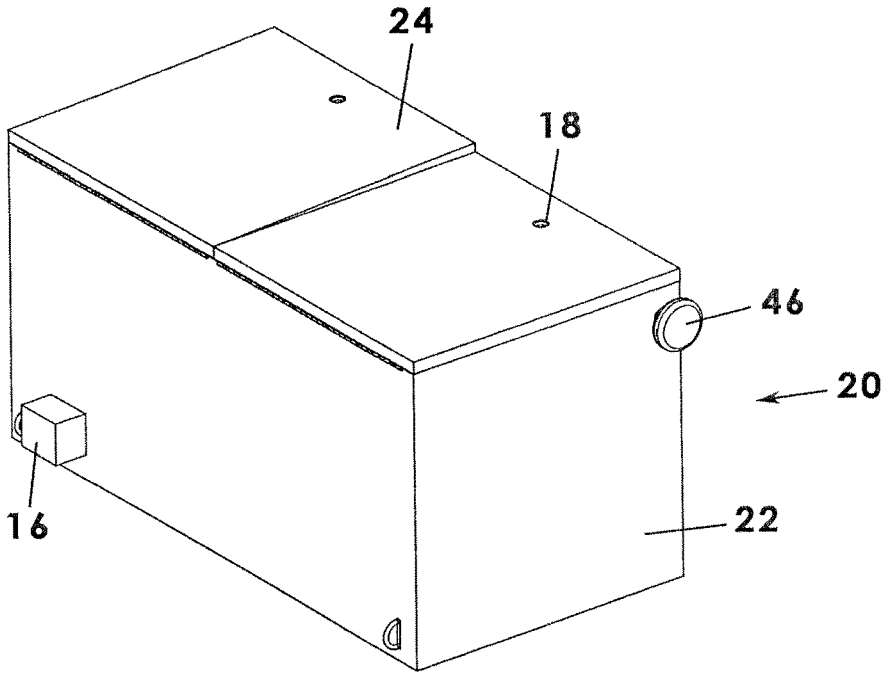
FIG. 3*b* is a rear perspective view of the delivery container as in FIG. 3*a;*

In another aspect, the delivery container 20 includes a lid locking assembly that is operable to lock the lid 24 in the full down configuration when closed by the delivery person. More particularly, the lid locking assembly may include a first lock portion 33 coupled to the lid 24 and a corresponding second lock portion 38 (also referred to as a striker plate) coupled to a wall of the delivery container 20, the lock portions being aligned with one another and configured to mate together when the lid 24 is lowered and closed. This action is illustrated in FIGS. 7*b* to 7*g*. The lid locking assembly may be referred to as a "slam lock" which is a type of lock known in the art that locks a door or panel automatically when it is closed. A slam lock, such as in the present invention—once locked—may be unlocked with a key inserted into keyhole 18 in a traditional manner (FIG. 3).

Figure 10A:
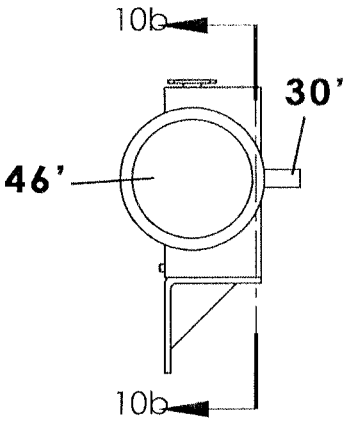
FIG. 10*a* is a side view of the kit as in FIG. 9*a;*
Figure 10B:
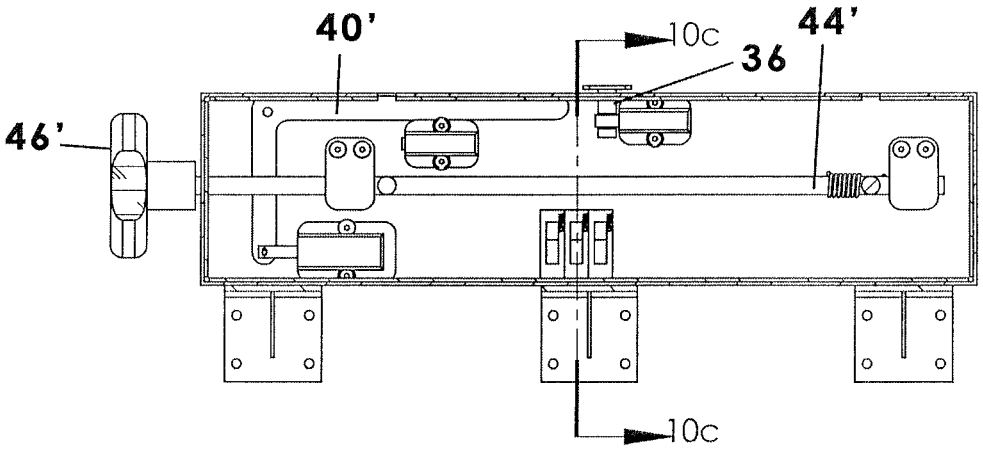
FIG. 10*b* is a sectional view taken along line 10*b*-10*b* of FIG. 10*a;*
Figure 10C:
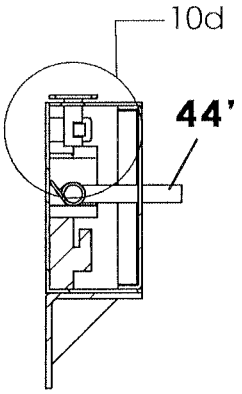
FIG. 10*c* is a sectional view taken along line 10*c*-10*c* of FIG. 10*b;*
Figure 10D:
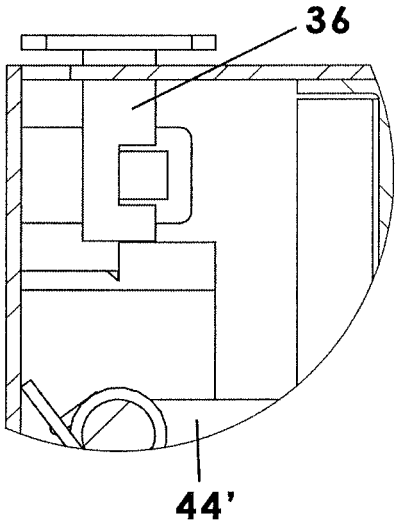
FIG. 10*d* is an isolated view on an enlarged scale taken from FIG. 10*c;*

As shown in FIGS. 10*b* and 11*e*, it is understood that in an embodiment, the slam lock may be an electromagnetic lock 36 operable for locking or releasing the lid 24. In addition, it is understood that, in an embodiment, the leg locks 27 may also be activated and deactivated according to electromagnetic constructions and operation. Specifically, the electromagnetic element of a leg lock 27 may include a portion that may be referred to as a "stop" and which may be a bolt, conductive flange, or the like, and which is used to hold the support leg 30 in the upright configuration until retracted or released—which occurs when the electromagnetic element is released such as by a mobile software app. When deactivated (i.e. released), the support leg 30 is allowed to move by its spring-loaded configuration to the downward configuration and the lid 24 may be locked upon closure and interaction with a corresponding striker plate 38. In an embodiment, a software application 50 is configured to activate or deactivate the electromagnet to hold the lid open or to allow it to close and lock automatically as will be described below. The software app may also be programmed and operable to transmit a signal to toggle the lid lock as will be described later in more detail.

In another aspect, a lid lifting arm 40 may be pivotally coupled to an inner surface of a respective wall of the delivery container and have a distal end configured to bear against and raise the lid 24 when actuated. The lid lifting arm 40 may be actuated to pivot and raise the lid 24 when actuated by an electrical lid lifting actuator 42. More particularly, the lid lifting actuator 42 may be a solenoid operable to actuate the lid lifting arm 40 to pivot when the solenoid is energized, whether by electrical connection to a battery or an AC power source (not shown). It is understood that the solenoid 42 may be mounted to an inner surface of a respective wall of the delivery container 20 and positioned within the interior area or be mounted using appropriate hardware or block. In other words, upon receiving an appropriate signal, the lid lifting actuator 42 is capable of almost instantly preparing the delivery container 20 to be ready for delivery of a parcel followed by self-locking of the lid 24, i.e. the lid lifting actuator 42 can put the delivery container 20 in a delivery-ready configuration.

The digital signals needed to cause actuation of the support legs 30 or lid lifting arm are provided by a software application and corresponding controllers (referred to as a software app or a "delivery application" noted by reference numeral 50). It is understood that the specific arrangement of instructions displayed by the delivery application 50 may combine many of the operations of the controllers described above and later so as to simplify control by a user in causing the delivery container 20 to be delivery-ready. More particularly, delivery application 50 having programming instructions may be installed and executed on a mobile communications device 12 (i.e. cell phone) associated with a residence, place of business, or location of the invention associated with an owner or resident. The input buttons of the mobile communications device may be used by a user to determine which instruction signals are to be transmitted. User input may be obtained using a touch screen and graphical user interface shown on a display 13. For instance, using the app, a user may determine to send a "lid lift" signal to the delivery container 20 in order that the lid 24 may be partially raised as part of preparing the container for an upcoming delivery as described above. Similarly, using the app, a user may determine to send a "support leg lift" signal to the delivery container 20 in order that the triggering assembly may be prepared for an upcoming delivery as described above (i.e. set the triggering assembly). Further still, a user may use the mobile app to cause a lid lock signal to be transmitted in order that the electronic lock, i.e. electromagnet, be activated or deactivated. Specifically, the user may enter instructions using input buttons of the mobile communications device 12, a touch screen graphic user interface (GUI), or by voice activated input.

Figure 2:
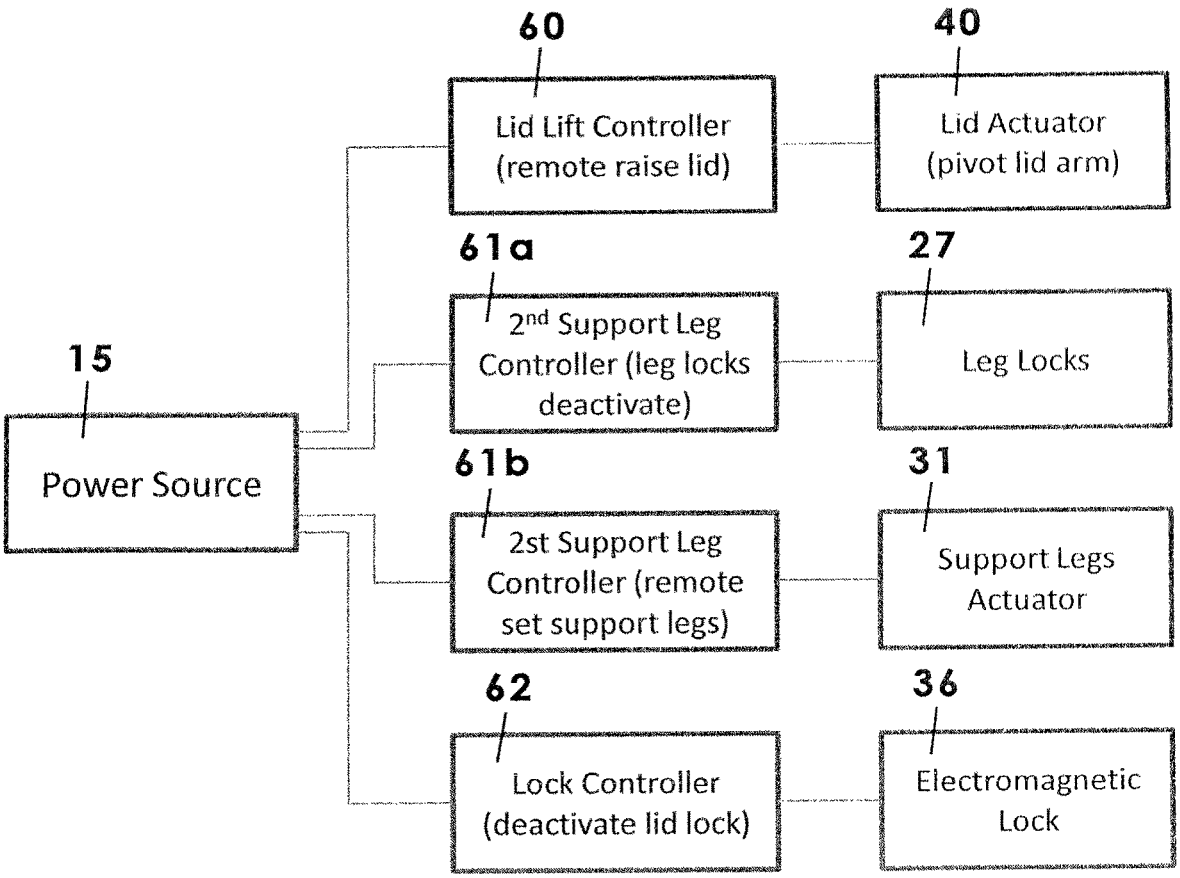
FIG. 2 is a block diagram illustrating the electronic components of the apparatus and method according to the present invention.

Even more specifically, a plurality of controllers may be mounted in the delivery container 20 (e.g. in an electronics box 16) and are electrically connected to respective electronic or electromagnetic elements for receiving respective signals and energizing respective actions, as illustrated in the block diagram of FIG. 2). More particularly, a lid lift controller 60 may be situated in the interior area of the delivery container 20, such as in the electronics box 16, the lid lift controller 60 being operable, such as with electronics, to receive a lid lift signal from the software app 50 and, as a result, is operable to energize and actuate movement of the lid lifting arm 40 to raise or open the lid 24 as described above.

Similarly, a first support leg controller 61*a* may be situated in the interior area of the delivery container 20, such as in the electronics box 16, the support leg controller 61*a* being operable, such as with electronics, to receive a respective leg lift signal from the software app and, as a result, is operable to actuate and release respective solenoids of the leg locks 27 (so as to allow the supports legs to spring to their normally down positions when the lid is subsequently raised by the delivery person). A second support leg controller 61*b* may be situated in the interior area of the delivery container 20, such as in the electronics box 16, the support leg controller 61*b* being operable, such as with electronics, to actuate the support leg actuator 31 to rotate the rod 44 and, as a result, the support legs 30 to their respective upward configurations holding open the lid 24 as described above.

With further reference to the magnetic lock described above, a lid lock controller 62 may be situated in the interior area of the delivery container 20, such as in the electronics box 16, the lid lock controller 62 being operable, such as with electronics (e.g. a receiver), to receive a lid lock signal from the software app and, as a result, is operable to activate or deactivate the magnetic lock 36—a deactivation thereof releasing the support leg 30 to return to its normally biased down configuration allowing the lid 24 to be closed automatically when a delivery person first opens the lid and then closes the lid after delivery of a parcel.

Now, with specific reference to the delivery container 20, the walls and the lid 24 may be arranged and appointed in the form of a porch bench. As porch benches have become common types of residential outdoor furniture, it would not be apparent to criminals that it is a parcel delivery box. More particularly, the lid 24 may include an upper surface having a planar configuration suitable for a person sitting thereon. A cushion 26, e.g. a pillow or pad, may be situated atop the lid 24 or may be coupled thereto. In addition, the walls of the delivery container 20 may define a pair of interior areas (or more) for receiving more than one parcel, respectively. The interior areas may be separated by a partition wall. Similarly, the lid 24 itself may be divided into two or more separated lid portions and operable to move between open (raised) and closed configurations to regulate access to the interior areas, respectively. The lid portions may be operated independently by an owner or resident via the software application as described above.

In another aspect, the present invention may include one or more signs having textual or pictorial indicia that informs a delivery person to leave a parcel in the delivery container 20, e.g. "Place Package in Box." In an embodiment, the indicia may include alphanumeric characters and an arrow. It is understood that the resident may position a sign when a delivery is anticipated and when the delivery container is either manually or electronically made ready for a delivery as described previously. In addition, the delivery person may be instructed by the resident himself via the video camera or video doorbell system described below.

In still another aspect and as illustrated in FIG. 1, the self-locking parcel delivery apparatus 10 may include a supplemental software application 52 (also referred to as the "video app") that may be installed on the mobile communications device 12 and which is in operative communication with a video motion detection system 14 that is installed and operative at the residence. It is understood that the video app 52 is preferably installed on the same mobile communications device on which the delivery app 50 described above for operating the self-locking parcel delivery apparatus 10 is installed. In fact, in some embodiments, the software application 50 and video app 52 may be integrated in a single app—particularly one that uses a graphical user interface (GUI) operable for selecting and activating various controllers installed in remote electronic devices in the manner described above.

Specifically, a resident may be notified of motion on his porch via the video app 52 and then, using the video app 52 and associated mobile communications device 12 to activate an associated doorbell or other video monitoring system to view and authenticate if the motion is being caused by an authorized person, such as a delivery person. Then, using the delivery application 50 (whether coded singly or in connection with the video application 52) to "set" the delivery container 20 into a delivery ready condition as described above. The delivery person may then lift the lid 24 sufficiently to reveal the interior area and to place a parcel therein. Thereafter, the lid 24 may be allowed to close where it is automatically locked—at least until it is either set again manually or set via the software application first described above. Of course, the delivery container 20 may have already been set, i.e. by the triggering device or manually, prior to use of the video application, e.g. the supplemental software, In still another embodiment, the invention first described above may be adapted to enable a homeowner or resident to arrange for a package to be picked up from the porch. It is understood that the technical structures and functional details are substantially similar. The resident may call a shipper and request pickup. Then, when a video doorbell detects the presence of the delivery person, the resident may speak to him, remotely activate an unlocking of the lid or lids of the delivery container or bench—thus allowing the package to be removed and taken for further delivery.

Figure 9A:
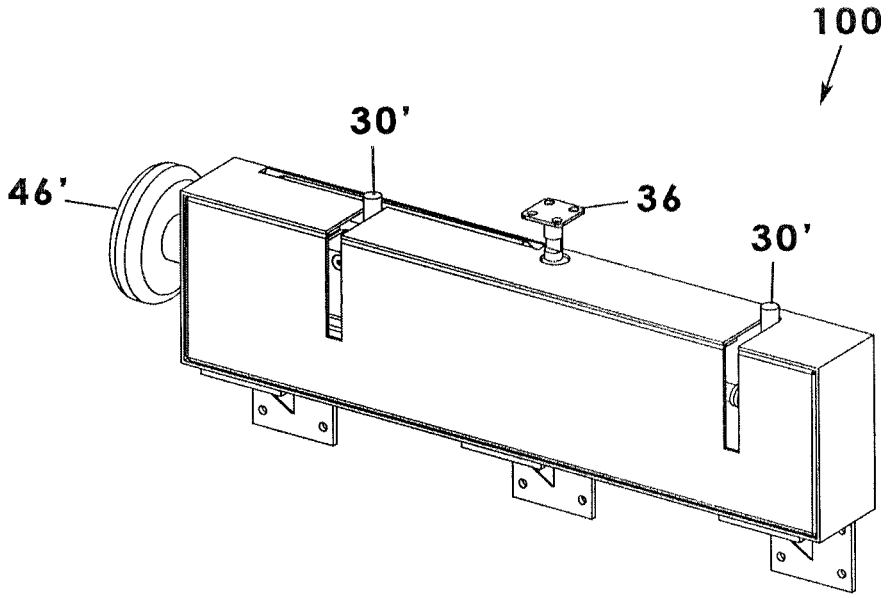
FIG. 9*a* is a perspective view of the present invention constructed in the form of a kit to be installed in a porch bench, illustrated with the support legs in a raised or deployed configuration.
Figure 9B:
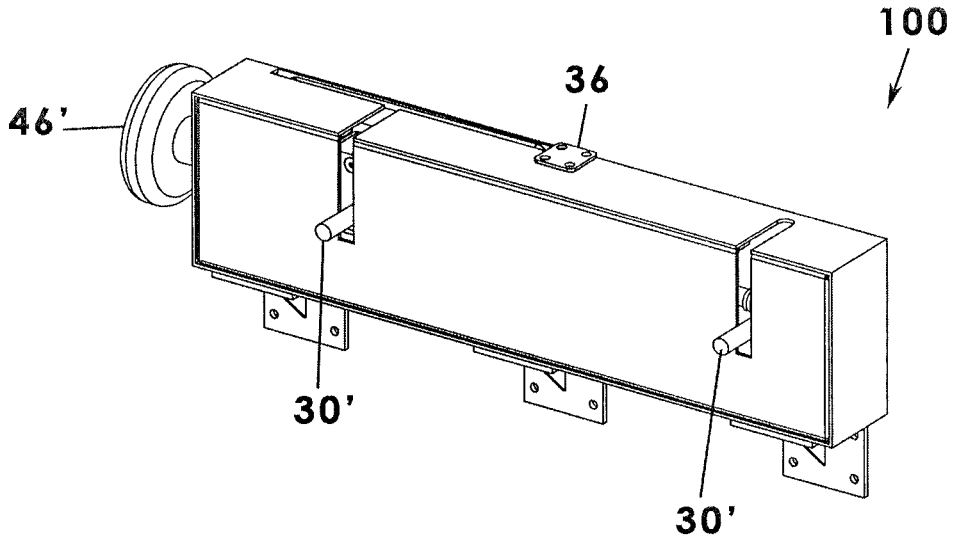
FIG. 9*b* is another perspective view of the kit-form of the invention as in FIG. 9*a* illustrated with the support legs in a released or down configuration.

In yet another embodiment, the present system may be arranged as a kit 100 to be installed in a purchaser's own existing porch bench, the kit 100 being described using primed numerals corresponding to the same or substantially similar structures described above. The kit form of the present invention is illustrated in FIGS. 9*a* to 10*b*. The kit 100 is illustrated with the support legs 30' in the upward configuration as well as in a down or retracted configuration as well as with the rod 44' and knob 46' which may be operated to set the trigger assembly as described above. The kit 100 also includes a magnetic locking device 36, illustrated in an unlocked or extended configuration (FIG. 9*a*) and also in a retracted or locked configuration (FIG. 9*b*). Other features may be disclosed in the provisional patent application upon which the present application depends and which is incorporated herein by reference. In addition, the kit 100 may include a slam lock and key option that is purely mechanical and not electronic (in a manner as described previously).

A related embodiment of the present invention is illustrated in FIGS. 12*a* to 14 and includes a secure delivery container 20 into which a package may be delivered to a residence or business substantially as described above. But, in another aspect, the delivery container 20' includes an electronic code reader assembly 200, such as a barcode reader 202, a QR reader, or similar code reading device that is operable to carry data indicative of an intended recipient, delivery address, and which is capable of generating data indicative of a time of actual delivery (i.e. real time delivery data), identification data associated with delivery person, and the like. In other words, the invention according to this embodiment may include electronics or software (or both), including a controller and memory, having data structures, such as may be stored in memory capable of storing the data described above and associated with a package being delivered and, specifically, being associated with a code, e.g. a barcode on the package being delivered.

It is well known, of course, that a delivery driver asks a recipient of a delivered package for his or her name and types this into an electronic device so as to then confirm a real time date and time of delivery and the identity of the recipient (e.g. the resident, a secretary, etc). Alternatively or additionally, the delivery person may scan the barcode on the package to associate the package with a time of delivery. Then, this information may be immediately uploaded to a database hosted by the delivery company as well as being transmitted directly or indirectly to an email associated with intended recipient or the sender, or both. So, in the present embodiment, the delivery container—with or without the audible voice of the resident as described above—is able to interact with the respective reader 202 associated with the delivery container 20 to, at least, obtain data indicative of the real time delivery, identity of the delivery person, confirm proper recipient, and the like, as well as to provide the delivery person with the same info she may have requested in a live delivery scenario.

Figure 13:
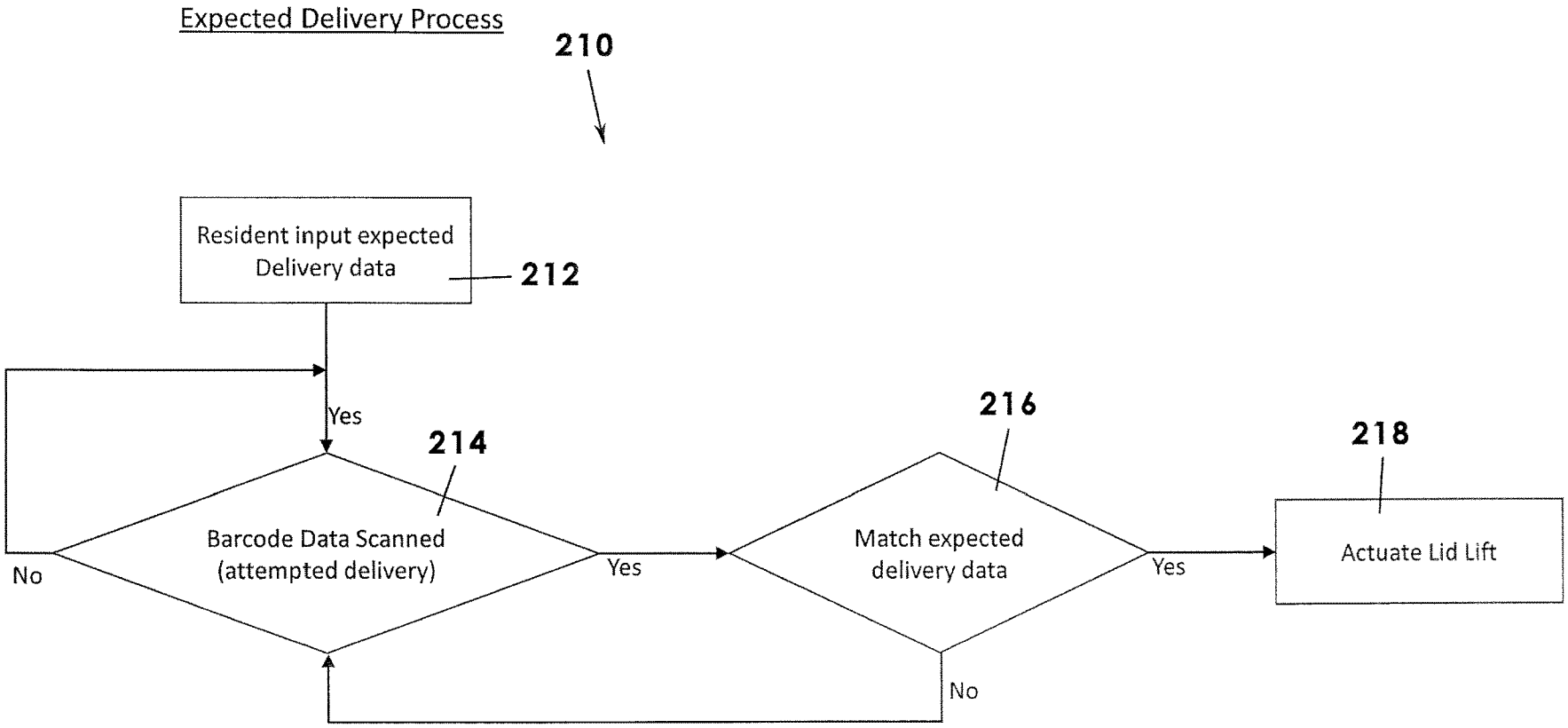
FIG. 13 is a flowchart illustrating a process for receiving an expected delivery.

Preferably, a user associated with the delivery container 20 and the reader 202 may be able to load or setup the reader assembly 200 with data associated with an expected delivery (i.e. an "authorized delivery") using yet another software application running on an electronic device (such as on a smart phone, laptop computer, or the like). This additional software application may be referred to as the "setup software application" of just as the setup software. If so programmed, the reader assembly 200 may only open the lid 24 so as to receive an attempted delivery if and when the reader 202, actuated by a delivery person scanning a tracking code, is deemed to be an authorized delivery. The reader 202 and associated electronics may transmit a signal to the setup software application indicating a parcel has been delivered along with respective data that was collected by the reader 202. It is understood that three software applications have been now proposed and disclosed and combinations of one, two, or all three may be combined in some embodiments and product models. A process 210 which illustrates the logic that may be performed by a barcode reader controller is shown in FIG. 13. Specifically, a resident is enabled to enter data into the barcode reader 202, such as via a software application or manually on the barcode reader itself as indicated at step 212. The process 210 then proceeds to step 214 where it waits until a delivery is attempted. When the controller detects that a barcode has been scanned, the process 210 proceeds to step 216; otherwise, the process 210 continues to wait. At step 216, the controller determines if the scanned barcode matches the data (such as a tracking number o other identification data) of the expected delivery data previously entered by the resident and, if so, the process 210 proceeds to step 218; otherwise, the process 210 does not allow a delivery to be made and returns to step 214 and awaits another barcode to be scanned. At step 218, the lid is automatically raised and made ready for delivery as described previously.

In an embodiment, the delivery container 20 and reader assembly 200 may be configured (such as via electronics or software) for an unexpected delivery. In this mode, the delivery container 20 may be configured to receive an unexpected package so long as a scanned package matches a predetermined recipient or address associated with the reader assembly 200. In other words, a resident's name and address may be input into the reader assembly 200, such as via the setup software application (i.e. resident identification data) so that when a package is scanned in—such as by a delivery person making use of the reader 202—the controller 204 of the reader 202 is configured to determine if delivery is allowed (such as via an address matching software module) and, if so, configures the lid 24 to be raised, the package accepted, and the delivery container 20 locked as described previously.

Figure 14:
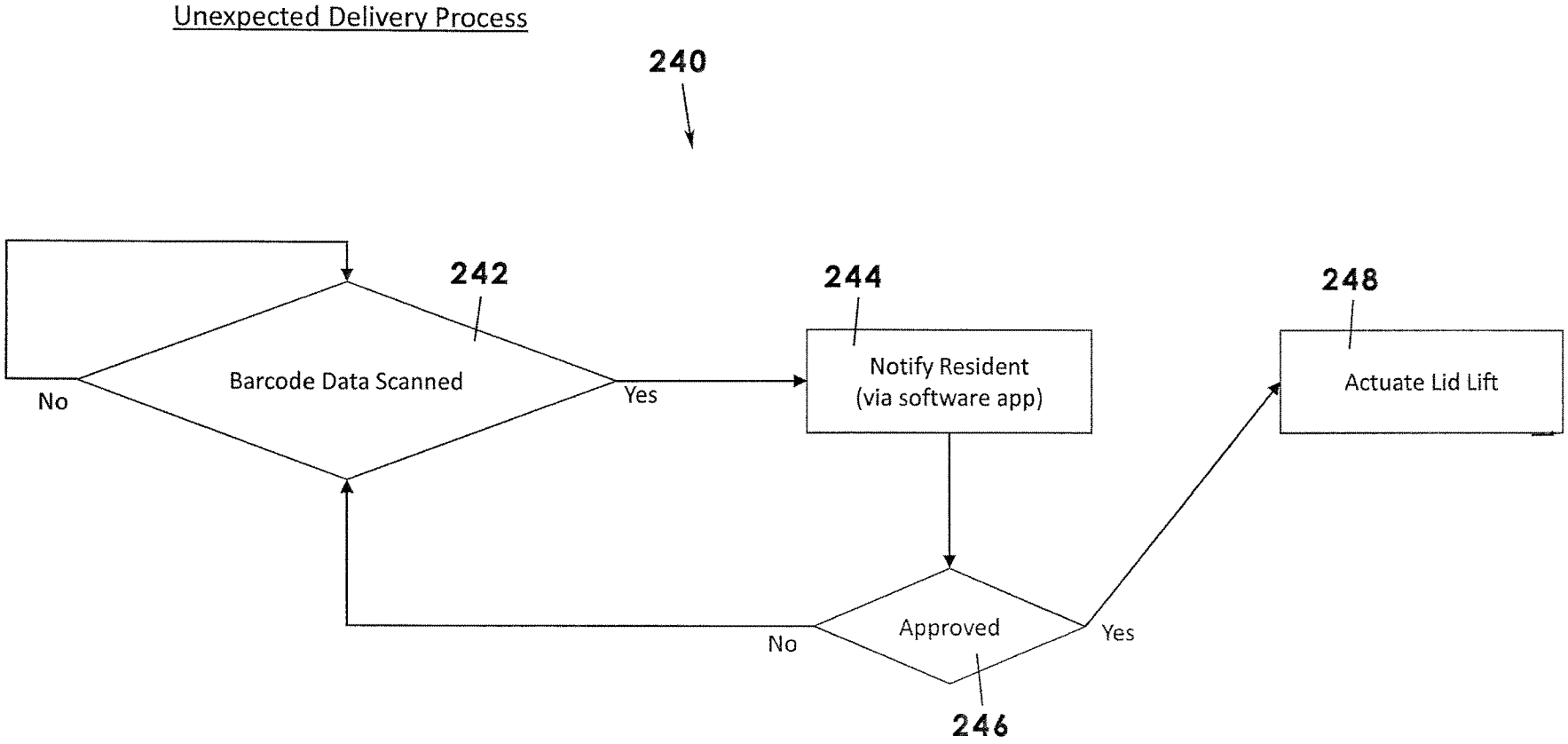
FIG. 14 is a flowchart illustrating a process for receiving an unexpected delivery.

A process 240 illustrates an unexpected delivery and is shown in FIG. 14. The process 240 begins at step 242 where it waits until a delivery is attempted. When the controller detects that a barcode has been scanned, the process 240 proceeds to step 244; otherwise, the process 240 continues to wait. At step 244, the resident associated with the barcode reader 202 is notified, such as by text message generated in real time by the software application described above, that a delivery is being attempted. The process 240 proceeds to step 246 where the controller determines if the resident approves of receiving the delivery (such as by confirming the delivery is from a trusted delivery company, the delivery person is trusted/known, or the package is otherwise deemed legitimate) and, of so, the process 240 proceeds to step 248. If not, the process 240 returns to step 242 and the process begins again. At step 248, the lid 24 is partially lifted and the delivery container 20 is made ready to receive the parcel as described previously.

Still further embodiments of the present invention are contemplated. Namely, use of a video doorbell system or even a camera situated on the delivery container 20 may be used and programmed to recognize a delivery vehicle or even the uniform worn by a delivery person and, upon recognition, the lid 24 may be prepared to receive a delivery/pickup as described above. Object and even facial recognition algorithms are known to persons of ordinary skill in the art although not having been implemented outside of social media and other online applications. Use in the art of package delivery would not be an obvious implementation.

In yet another variation (not shown), circuitry, electronics, and actuators similar to those described above regarding leg or lid lifting assemblies can also be employed for deploying the delivery sign. In other words, the delivery sign may be mounted to an arm coupled to the delivery container 20 in a movable between retracted and deployed configurations in a manner analogous to a stop sign associated with a school bus. In addition, an actuator may be energized using the remote operational software application described above to selectively deployed the delivery sign at the same time the lid is raised and prepared for a package delivery.

It is understood that while certain forms of this invention have been illustrated and described, it is not limited thereto except insofar as such limitations are included in the following claims and allowable functional equivalents thereof.

The invention claimed is:

1. A method for securing a delivered parcel at a consumer's residence or place of business that operates a video motion detection system, said method comprising:

receiving a parcel into an interior area of a delivery container having a plurality of walls, said delivery container having a lid atop said plurality of walls that is pivotally movable from (1) a closed configuration in which said lid is closed and does not allow access to said interior area to (2) an open configuration in which said lid is partially raised to allow access to said interior area;

activating a triggering assembly in said interior area of said delivery container to pivotally move said lid between a deployed configuration extending upwardly out of said interior area for holding said lid in said open configuration and a retracted configuration inside said interior area allowing said lid to move to said closed configuration;

locking said lid in said closed position via a lid locking assembly that is cooperatively coupled to said lid and to a respective wall of said delivery container and operable to automatically lock said lid in said closed configuration when said lid is first opened for parcel delivery and then fully closed;

running a supplemental software application on a mobile communications device that is in data communication with the video motion detection system located proximate said delivery container;

the supplemental software application receiving a notification signal indicative of motion having been detected by the video motion detection system and displaying a video signal on the mobile communications device in order to authenticate that said notification signal is caused by an authorized delivery person;

wherein said triggering assembly includes a support leg having a leg lock having a retractable stop that holds said triggering assembly in said deployed configuration until said retractable stop is actuated to retract which allows said support leg to return automatically to said retracted configuration when said lid is raised during parcel delivery.

2. The method as in claim 1, further comprising:

running a software application on a mobile communications device associated with the residence or place of business, said software application operable to transmit a lid lift signal; and a lid lift controller situated in said interior area receiving said lid lift signal from said software application to raise or lower said lid; and, when received, actuating said triggering assembly.

3. The method as in claim 1, wherein said locking assembly includes a first lock portion coupled to said lid and a second lock portion coupled to an inner surface of a respective wall of said delivery container, said first and second lock portions being in alignment so as to automatically lock said lid in said closed configuration after said lid is first opened for parcel delivery and then fully closed.

4. The method as in claim 1, wherein a terminal end of the support leg is held in said deployed configuration by contact with said lid when said lid is at said open configuration awaiting delivery of the parcel, said support leg being spring-biased to return automatically to said retracted configuration after said lid is opened during parcel delivery.

5. A self-locking parcel delivery apparatus for receiving a delivered parcel at a residence or place of business, comprising:

a delivery container having a plurality of walls coupled together and defining an interior area for receiving a parcel and having a lid that is pivotally movable from (1) a closed configuration in which said lid is closed and preventing access to said interior area to (2) an open configuration in which said lid is partially raised to allow access to said interior area;

a triggering assembly positioned in said interior area and pivotally movable between a retracted configuration situated inside said interior area and a deployed configuration extending upwardly out of said interior area that holds said lid in said open configuration; and a lid locking assembly coupled to said lid and to a respective wall of said delivery container and operable to automatically lock said lid in a closed configuration after said lid is first opened for parcel delivery and then fully closed;

a lid lifting arm pivotally coupled to a respective wall of said delivery container and positioned to bear against and raise said lid when actuated;

a lid lifting actuator positioned in said interior area and electrically connected to said lid lifting arm;

a software application running on a mobile communications device associated with the residence or place of business, said software application operable to transmit a lid lift signal; and a lid lift controller situated in said interior area that is operable to receive said lid lift signal from said software application and, when received, to energize said lid lifting actuator to actuate said lid lifting arm.

6. The self-locking parcel delivery apparatus as in claim 5, wherein:

said locking assembly includes an electromagnet;

said software application is operable to transmit a lid lock signal;

said self-locking parcel delivery apparatus further comprising a lid lock controller that is operable to receive the lid lock signal from said software application and, when received, to de-energize said electromagnet.

7. The self-locking parcel delivery apparatus as in claim 5, wherein said delivery container is a porch bench having a cushion mounted atop an outer surface of said lid for cushioning a person sitting on said cushion.

8. The self-locking parcel delivery apparatus as in claim 5, wherein:

said triggering assembly includes a support leg;

a terminal end of said support leg is held in said deployed configuration by contact with said lid when said lid is at said open configuration awaiting delivery of the parcel, said support leg being spring-biased to return automatically to said retracted configuration after said lid is opened during parcel delivery.

9. The self-locking parcel delivery apparatus as in claim 5, wherein said locking assembly includes a first lock portion coupled to said lid and a second lock portion coupled to an inner surface of a respective wall of said delivery container, said first and second lock portions being in alignment so as to automatically lock said lid in said closed configuration after said lid is first opened for parcel delivery and then fully closed.

10. The self-locking parcel delivery apparatus as in claim 5, wherein said triggering assembly includes a support leg having a leg lock having a retractable stop that holds said triggering assembly in said deployed configuration until said retractable stop is actuated to retract which allows said support leg to return automatically to said retracted configuration when said lid is raised during parcel delivery.

* * * * *